US006004032A

United States Patent [19]

Kapperman et al.

[11] Patent Number: 6,004,032

[45] Date of Patent: Dec. 21, 1999

[54] TAMPER-EVIDENT CLOSURE ARRANGEMENTS AND METHODS

[75] Inventors: Elizabeth J. Kapperman, Appleton; Timothy J. May, Greenville; Bill C. Munger, Appleton; Gregory L. Petkovsek, Appleton; Mladomir Tomic, Appleton, all of Wis.

[73] Assignee: Reynolds Consumer Products, Inc., Appleton, Wis.

[21] Appl. No.: 09/107,976

[22] Filed: Jun. 30, 1998

[51] Int. Cl.[6] ..... B65D 33/14

[52] U.S. Cl. ..... 383/5; 24/587; 383/63

[58] Field of Search ..... 383/5, 63; 24/587

[56] References Cited

U.S. PATENT DOCUMENTS

| | | | |
|---|---|---|---|
| 3,338,284 | 8/1967 | Ausnit . | |
| 3,780,781 | 12/1973 | Uramoto . | |
| 4,000,768 | 1/1977 | Siegel | 383/63 |
| 4,268,938 | 5/1981 | Walchli | 383/63 |
| 4,528,224 | 7/1985 | Ausnit | 383/63 |
| 4,615,045 | 9/1986 | Siegel . | |
| 4,637,061 | 1/1987 | Riese . | |
| 4,756,628 | 7/1988 | Branson | 383/63 |
| 4,784,754 | 11/1988 | Herrington | 383/63 |
| 4,791,710 | 12/1988 | Nocek . | |
| 4,795,269 | 1/1989 | Scheibner . | |
| 4,817,188 | 3/1989 | Van Erden . | |
| 4,829,641 | 5/1989 | Williams . | |
| 4,832,505 | 5/1989 | Ausnit et al. . | |
| 4,858,286 | 8/1989 | Siegel . | |
| 4,863,286 | 9/1989 | Branson . | |
| 4,878,763 | 11/1989 | Ausnit . | |
| 4,925,318 | 5/1990 | Sorensen . | |
| 4,947,525 | 8/1990 | Van Erden . | |
| 4,964,739 | 10/1990 | Branson et al. . | |
| 4,966,470 | 10/1990 | Thompson et al. . | |
| 4,969,967 | 11/1990 | Sorensen et al. . | |
| 5,017,021 | 5/1991 | Simonsen et al. | 383/63 |
| 5,185,909 | 2/1993 | Inagaki . | |
| 5,186,543 | 2/1993 | Cochran | 383/63 |
| 5,188,461 | 2/1993 | Sorensen . | |
| 5,216,787 | 6/1993 | Custer et al. . | |
| 5,242,516 | 9/1993 | Custer et al. . | |
| 5,248,201 | 9/1993 | Kettner et al. . | |
| 5,372,428 | 12/1994 | Bruno et al. . | |
| 5,425,825 | 6/1995 | Rasko et al. | 383/63 |
| 5,435,864 | 7/1995 | Machacek et al. | 383/63 |

*Primary Examiner*—Stephen P. Garbe
*Attorney, Agent, or Firm*—Alan M. Biddison

[57] ABSTRACT

Closure arrangements for use with flexible packages include a zipper-type closure, which, after initial sealing, if access is gained to a package interior, the arrangements provide evidence of that access. In certain embodiments, a closure with mating male and female profiles is used which, after initial sealing of the package, if access is desired to the package interior, one of the male or female profiles breaks, to prevent a resealing of the package. In other embodiments, after initial mating of the male and female closure profiles in order to seal the package, if access is desired to the package interior, the package walls are torn in order to gain access. In other embodiments, after initial sealing of the package by mating of the male and female profiles, if access is desired to the package interior, the male and female profiles are deformed, such that they no longer mate to provide a secure closure. Methods for using the arrangements herein are also provided.

12 Claims, 6 Drawing Sheets

TAMPER-EVIDENT CLOSURE ARRANGEMENTS AND METHODS

FIELD OF THE INVENTION

The present invention generally relates to closure arrangements for polymeric packages. In particular, the present invention relates to tamper-evident closures.

BACKGROUND OF THE INVENTION

Many packaging applications use containers with zipper-type closure arrangements to store various types of articles and materials. These packages may be used to store and ship non-food consumer goods, food products, medical supplies, waste materials, and many other articles.

Concerns are sometimes raised with respect to recloseable zipper-type closure arrangements. These concerns relate to the fact that in many zipper-type closure arrangements, it is not evident that the package has been opened. This may lead to product-tampering and other problems. In addition, in certain instances, it may be desirable to be able to quickly and manually seal a package and still be able to detect whether the package has been unsealed after the initial sealing.

SUMMARY OF THE INVENTION

The disclosure herein describes several embodiments of a tamper-evident closure arrangement. By "tamper-evident", it is meant that there is no way to access the package interior without damaging the closure arrangement or the package. In certain embodiments, the closure arrangement is a zipper-type closure, which allows for quick, manual sealing of a package. After initial sealing, if access is gained to the package interior, the arrangements herein provide evidence of that access.

In certain embodiments, the zipper-type closure arrangement includes mating male and female profiles. After initial sealing of the package by mating the male and female profiles, if access is desired to the package interior, one of the male or female profiles breaks, to prevent a resealing of the package.

In other embodiments, after initial mating of the male and female closure profiles in order to seal the package, if access is desired to the package interior, the package walls are torn in order to gain access.

In other embodiments, after initial sealing of the package by mating of the male and female profiles, if access is desired to the package interior, the male and female profiles are deformed, such that they no longer mate to provide a secure closure.

Methods for using a flexible package are provided herein. In certain methods, there are steps of providing a flexible package having an interior, a mouth providing access to the interior, and a zipper closure; sealing the mouth in a closed position to block access to the interior by closing the zipper closure; and accessing the package interior to render the zipper closure inoperable to again block access to the interior.

In other methods, the flexible package has a first closure profile and a second closure profile, where the first closure profile has a post precluding interlocking engagement between the first and second profiles. The post is removed from the first closure profile, and the mouth is sealed in a closed position to block access to the interior by mateably interlocking the first and second profiles.

Some methods for using a flexible package preferably use constructions as described herein.

The above summary of the inventions is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
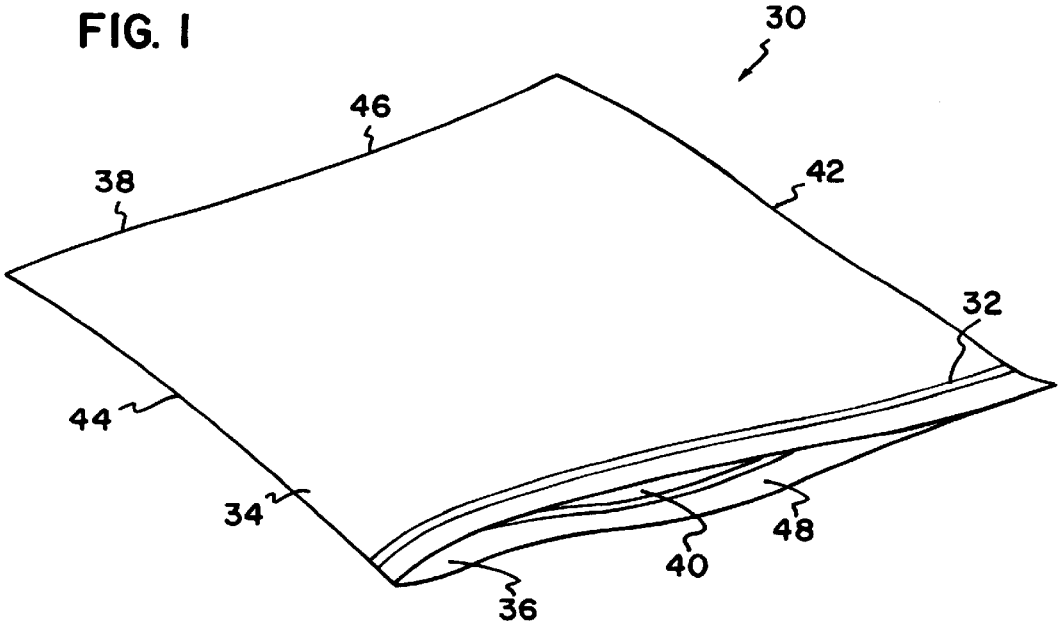
FIG. 1 is a perspective view of a flexible package according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

According to an example embodiment of the present invention, a package includes a closure arrangement to allow for quick, manual closure and sealing of a package, while providing a way for checking whether the package has been opened after the initial sealing. FIG. 1 illustrates an example type of package 30 that benefits from use of such a closure arrangement.

FIG. 1 illustrates an example packaging arrangement in the form of a flexible package 30 having a closure mechanism 32 constructed in accordance with the present invention. The flexible package 30 includes first and second opposed panel sections 34, 36 made from a flexible, polymeric film. For some manufacturing applications, the first and second panel sections 34, 36 are heat-sealed together along two edges and meet at a fold line 38 in order to form a 3-edged containment section for a product within an interior 40 of the package 30. The fold line 38 comprises a product-supporting bottom or bottom edge 46, depending on the orientation which the package 30 is held. Alternatively, two separate panel sections 34, 36 of polymeric film may be used and heat-sealed together along two opposite edges 42, 44 and along edge 46. Access is provided to the interior 40 of the package 30 through a mouth 48.

Package 30 includes a product side and a consumer side. As used herein, the term "product side" refers to the volume inside of the package 30 between the closure mechanism 32 and the edges 46, 42, and 44. The "consumer side" refers to a side opposite of the product side, and is the region of the package 30 accessible by the user when the closure mechanism 32 is in a closed or sealed orientation.

The flexible package 30 may be used to hold a variety of products. Such products may include groceries, edible food products, clothing, and other things.

Closure mechanism 32 is illustrated in FIG. 1 at the mouth 48 of the flexible package 30. Each closure mechanism 32 extends the width of the package 30. In one particular embodiment illustrated in FIGS. 2–4, the closure mechanism 32 of FIG. 1 is shown in the specific form of a zipper-type mechanism 50. By the term "zipper-type mechanism", it is meant a structure having oppositely disposed interlocking or mating profiles, which under the application of pressure, will interlock and block access between the profiles.

Figure 2:
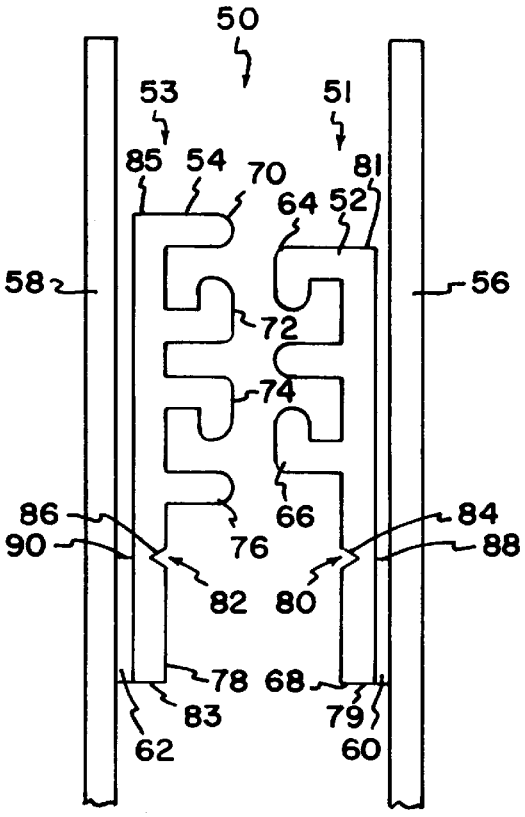
FIG. 2 is a fragmented, cross-sectional, schematic view of a closure mechanism, according to an example embodiment of the present invention.
Figure 3:
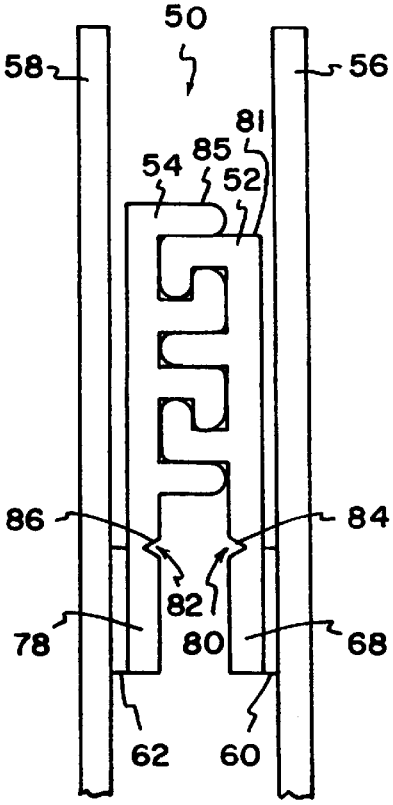
FIG. 3 is a fragmented, cross-sectional, schematic view of the closure mechanism illustrated in FIG. 2 and depicted in a mating or sealed orientation, according to an example embodiment of the present invention.
Figure 4:
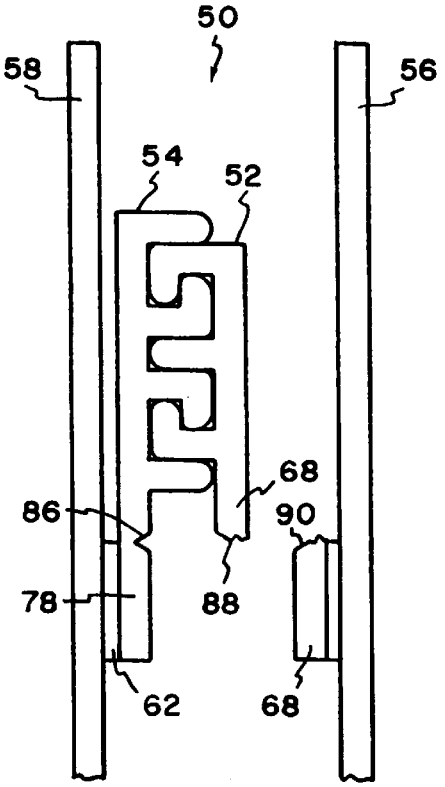
FIG. 4 is a fragmented, cross-sectional, schematic view of the closure mechanism depicted in FIGS. 2 and 3 and showing one of the profiles broken, according to an example embodiment of the present invention.

Attention is directed to FIGS. 2–4. In FIGS. 2–4, closure mechanism 50 is illustrated as having a first closure member 51 and an oppositely disposed second closure member 53. First closure member 51 includes a male closure profile 52, and second closure member 53 includes a female closure profile 54. Each of first closure member 51 and second closure member 53 is secured to a respective wall section 56, 58 of a flexible package. For example, wall section 56 may correspond to first panel section 34 (FIG. 1), while wall section 58 corresponds to second panel section 36 (FIG. 1). Each of first and second closure members 51, 53 may be secured to its respective wall section 56, 58 through a variety of processes such as heat-sealing, adhesive, sealant layers, or combinations thereof. In the specific embodiment illustrated in FIG. 2, first closure member 51 is secured to wall section 56 by sealant layer 60. Analogously, second closure member 53 is secured to wall section 58 through sealant layer 62. Sealant layers 60, 62 typically are made from EVA or ethylene vinyl acetate copolymers.

Closure mechanism 50 illustrates a dual-track zipper. By "dual-track zipper", it is meant the first and second closure members 51, 53 have two tracks, typically one immediately adjacent to the next, which interlocks with its oppositely disposed profile member. For example, in FIG. 2, first closure member 51 comprises male profile 52 with first and second male members 64, 66 in extension from a base strip 68. The second closure member 53 comprises female closure profile 54 having a first pair of legs, 70, 72 for enclosing first male member 64, and a second pair of legs 74, 76 for enclosing and interlocking with second male member 66. Legs 70, 72, 74, 76 extend from a female base strip 78. The combination of first male member 64 and legs 70, 72 forms the first track of the dual track zipper arrangement. Analogously, the combination of second male member 66 and legs 74, 76 form the second track of the dual track closure mechanism.

In general, first closure member 51 has first and second opposite ends 79, 81. At first end 79, base strip 68 comprises an attachment flange for securing the first closure member 51 to the wall 56. At second end 81 is disposed male profile 52. In the embodiment illustrated, male profile 52 is free from and unattached to wall 56. Note also that first closure member 51 terminates at second end 81 with male profile 52. That is, there is no additional flange extending from the male profile 52 toward the consumer side of the package. Similarly, second closure member 53 has first and second opposite ends 83, 85, which function analogously to ends 79, 81. Female profile 54 is free from and unattached to wall 58, and no additional flanges extend from female profile 54 toward the consumer side.

FIG. 3 illustrates the closure mechanism 50 in a locked or sealed orientation. That is, male and female profiles 52, 54 are mated and interlocked with each other to prohibit access between male profile 52 and female profile 54. Arranged in a flexible package such as that illustrated at 30 in FIG. 1, the locked or sealed orientation of FIG. 3 will prevent access to package interior 40. Due to the lack of flanges extending from the male and female profiles 52, 54 toward the consumer side, the user cannot unlock the male and female profiles from ends 81, 85.

Closure mechanism 50 is constructed and arranged to prevent access to package interior 40 after being placed in its closed or sealed orientation, without providing an indication to a person that the closure mechanism 50 has already been sealed once. While a variety of working embodiments are contemplated herein, in FIGS. 2–4, closure mechanism 50, in general, is configured to be rendered inoperative after initial closing of the closure mechanism 50 and after access is gained to package interior 40. In other words, closure mechanism 50 is transformable from a lockable orientation (FIGS. 2 and 3) to an unlockable orientation (FIG. 4) by disengaging the interlocked male and female profiles 52, 54. Specifically, closure mechanism 50 is designed to break apart and mechanically fail after initial closing (FIG. 3), in order to gain access to the product side of the closure mechanism 50.

Specifically, closure mechanism 50 includes a mechanically weakened region in at least one of its male and female profiles 52, 54. After initial interlocking of the male and female profiles 52, 54, when a pulling force is exerted upon the closure mechanism 50, the closure mechanism will mechanically fail or break at the weakened region. More particularly, in the example illustrated in FIGS. 2 and 3, base strip 68 of male profile 52 includes a weakened region 80. Similarly, female base strip 78 includes a mechanically weakened region 82.

Weakened region 80 may comprise a transverse extending die line 84 in the base strip 68. Analogously, weakened region 82 may comprise a transverse extending die line 86. As can be seen in FIGS. 2 and 3, die lines 84. 86 are shown by regions of reduced cross-section in their respective base strips 68, 78. Because the cross-sectional areas at die lines 84, 86 are reduced relative to the cross-sectional areas of other regions of the base strips 68, 78, die lines 84. 86 are mechanically weakened regions. Note that die lines 84, 86 are located adjacent to or even with ends 88, 90 of sealant layers 60, 62, respectively. This location of die lines 84. 86 also helps to promote a mechanically weakened region at die lines 84, 86.

While weakened regions 80, 82 are illustrated in FIGS. 2 and 3 as die lines 84, 86, in other embodiments, weakened regions 80, 82 may be transverse perforated lines extending across base strips 68, 78.

In use, closure mechanism 50 operates in the following manner. A flexible package, such as package 30, will include closure mechanism 50 in an unlocked or unsealed orientation (FIG. 2). Items, such as groceries or other consumer products, will be placed into the package interior 40 through the mouth 48. The closure mechanism 50 will be sealed or closed by applying pressure to the male and female profiles 52, 54 in order to mate and interlock them. The closed orientation is shown in FIG. 3. The closed orientation prevents access to the interior 40 and the product side of the package 30. In order to gain access to the product side of the package 30 and to the items within the interior 40, the user grasps opposite wall sections 56, 58 and applies a pulling force in a direction outwardly from the closure mechanism 50. By applying the pulling force, the user will cause one of the weakened regions 80, 82 of base strips 68, 78 to mechanically fail. That is, at least one of the weakened regions 80, 82 will tear or rip along die line 84, 86, respectively. In FIG. 4, base strip 68 is shown torn along what was die line 84 (FIG. 3). Access is then permitted to the product side of the flexible package 30 due to the opening created by the torn region 88, 90.

One example application of the embodiment of FIGS. 2–4 is in a department store. For example, after selling goods such as groceries, clothing, etc., the department store employee can quickly and manually (without tools) seal the sold products in a flexible bag or package. The customer can then be handed the bag with the purchased goods within it. If the customer inappropriately attempts to open the bag prior to leaving the store to place additional, unpurchased products within the bag interior, the bag will be damaged, through either torn bag side walls or through the broken base strips 68, 78 of the closure mechanism 50. Before each customer is allowed to exit the store, his or her package is inspected for damage of this type. If damage of this type is detected, the entire contents of the bag are inspected for evidence of purchase.

It should be noted that in FIG. 4, while base strip 68 has been shown to be torn, in other applications, base strip 78 will be torn instead.

Figure 5:
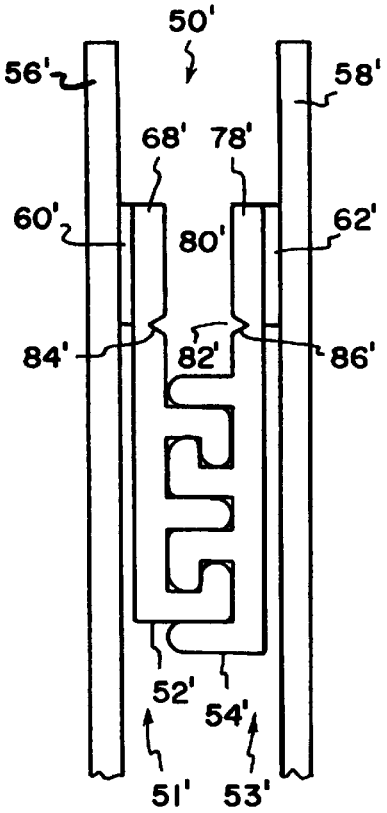
FIG. 5 is a fragmented, cross-sectional, schematic view of an alternate embodiment of the closure mechanism depicted in FIG. 2, according to an example embodiment of the present invention.

Attention is directed to FIG. 5. In FIG. 5, a modification of the closure arrangement of FIGS. 2–4 is shown generally as closure mechanism 50'. Closure mechanism 50' includes structure analogous to closure mechanism 50. Specifically, closure mechanism 50' has a first closure member 51' and a second closure member 53'. First closure member 51' has a male profile 52', and second closure member 53' has an oppositely disposed female profile 54'. First and second closure members 51' and 53' are attached to package walls 56', 58', respectively, through sealant layers 60', 62', respectively. Male base strip 68' includes a weakened region 80' including a die line 84'. Female base strip 78' includes a weakened region 82' including die line 86'. In the embodiment of FIG. 5, sealant layers 60', 62' are located closer to the consumer side of the package than the male and female profiles 52', 54'. That is, the male and female profiles 52', 54' are located between the sealant layers 60', 62' and the bottom edge 46 of FIG. 1. This is in contrast with the embodiment shown in FIGS. 2–4, where the male and female profiles 52, 54 are located closer to the consumer side of the package than the sealant layers 60, 62. The general orientation and arrangement of the closure mechanism 50' of FIG. 5 will allow for expanded side walls 56', 58' on the product side of the package in the region of closure profiles 52', 54'. Again, as with the embodiment of FIGS. 2–4, after sealing the closure mechanism 50' in the closed orientation of FIG. 5, access is blocked to the product side of the package until tearing along one of the die lines 84', 86' of the closure mechanism 50'. In this manner, it will be apparent to someone inspecting the package that the package was closed and then reopened.

Figure 6:
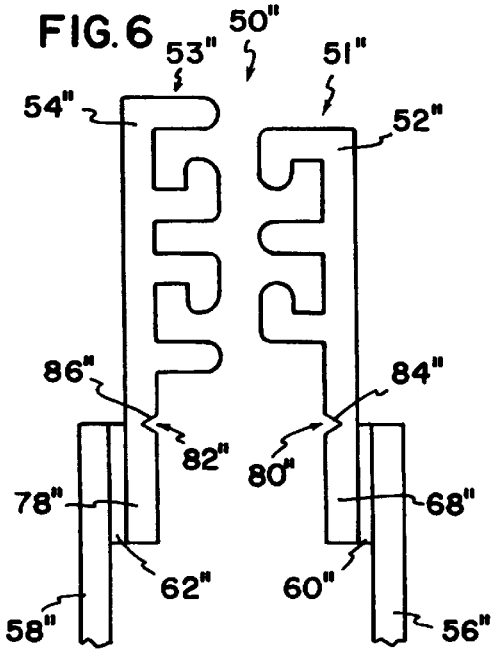
FIG. 6 is a fragmented, cross-sectional, schematic view of another alternative embodiment of the closure mechanism depicted in FIG. 2, according to an example embodiment of the present invention.

Attention is directed to FIG. 6. In FIG. 6, a modification of the closure arrangement 50 of FIGS. 2–4 is shown generally at 50". Closure mechanism 50" includes analogous structure as that described above for FIGS. 2–4. Specifically, closure mechanism 50" includes a first closure member 51", having a male profile 52", and an oppositely disposed second closure member 53", having a female profile 54". First and second closure members 51", 53" are secured to bag walls 56", 58" at sealant layers 60", 62", respectively. Male base strip 68" and female base strip 78" define weakened regions 80", 82", including die line 84", 86", respectively. In FIG. 6, male and female profiles 52", 54" are oriented outside of the bag walls 56", 58". Closure mechanism 50" operates analogously to closure mechanism 50 (FIGS. 2–4) and closure mechanism 50' (FIG. 5). That is, after interlocking the male profile 52' and female profile 54", in order to access the product side of the package, either of the bag walls 56", 58" must be ripped, or one of the die lines 80", 82" must be torn.

Figure 7:
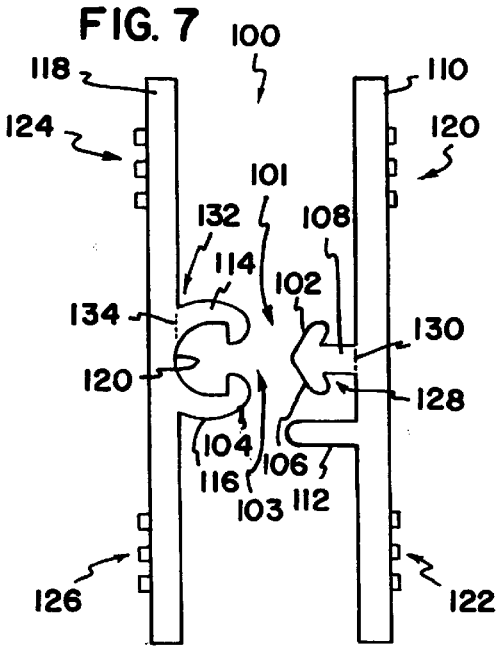
FIG. 7 is a fragmented, cross-sectional, schematic view of another embodiment of a closure mechanism, according to an example embodiment of the present invention.

Attention is now directed to FIG. 7. In FIG. 7, a second embodiment of a closure mechanism is shown generally at 100. Closure mechanism 100 generally includes oppositely disposed, interlocking first and second closure members 101, 103, such as male profile 102 and female profile 104. While a variety of profile shapes may be used, in the particular embodiment illustrated in FIG. 7, male profile 102 includes an expanded male head 106 and stem 108 extending from a base flange or strip 110. Further, in some embodiments, male profile 102 also includes post 112 extending from base strip 110.

Female profile 104 includes a pair of legs 114, 116 extending from base strip 118. Legs 114, 116 are depicted as generally J-shaped bending toward each other to define an open orifice 120 or receiving trough for receipt of male head 106.

Closure mechanism 100 is secured to walls of a flexible package, such as package 30 in FIG. 1. In the example illustrated in FIG. 7, base strip 110 includes a plurality of sealant ribs 120, 122 for sealing and securing male profile 102 to a wall of a flexible package. Similarly, base strip 118 includes a plurality of sealant ribs 124, 126 for securing female profile 104 to a wall of a flexible package. In general, sealant ribs 120, 122, 124, 126 comprise EVA material and provide a strong, durable holding force between profiles 102, 104 to respective package walls. Rib constructions of this type are described in U.S. Pat. No. 5,242,516, which patent is hereby incorporated by reference.

Closure mechanism 100 is constructed and arranged to prevent access to the product side of the closure mechanism 100 after initial closure, without either causing the package walls to be ripped or by rendering closure mechanism 100 inoperable. In other words, closure mechanism 100 is transformable from a lockable orientation (FIGS. 7 and 8) to an unlockable orientation (FIGS. 9 and 10) by disengaging the locked male and female profiles 102, 104. In the arrangement of FIG. 7, closure mechanism 100 includes a weakened region in at least one of the male profile 102 or female profile 104. Upon application of a pulling force on closure mechanism 100, closure mechanism 100 will mechanically fail at its weakened region, and render closure mechanism 100 inoperable.

In the specific embodiment illustrated in FIG. 7, male profile 102 includes a weakened region at 128. Specifically, weakened region 128 comprises either a transverse perforation or die line 130 at the base of the stem 108, where stem 108 joins base strip 110.

Analogously, female profile 104 includes a weakened region at 132. Weakened region 132 may comprise a transverse perforation or die line 134 at a base of leg 114, in the region where leg 114 joins base strip 118. In other embodiments, there may be a weakened region in leg 116, instead. Alternatively, in other embodiments, both legs 114, 116 will include weakened regions.

Figure 8:
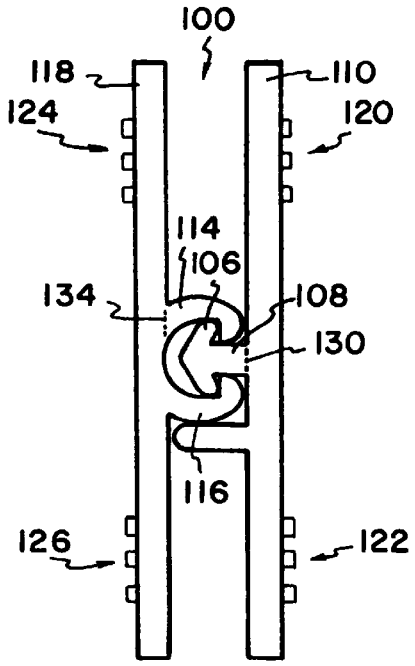
FIG. 8 is a fragmented, cross-sectional, schematic view of the closure mechanism depicted in FIG. 7 in a mating or sealed orientation, according to an example embodiment of the present invention.

FIG. 8 illustrates closure mechanism 100 in a closed, or sealed, or interlocked orientation. As can be used in FIG. 8, male head 106 is encaptured within and between legs 114, 116. Male stem 108 is shown extending from base strip 110, and die line 130 is intact. Female leg 114 is extending from base strip 118, and die line 134 is intact.

Figure 9:
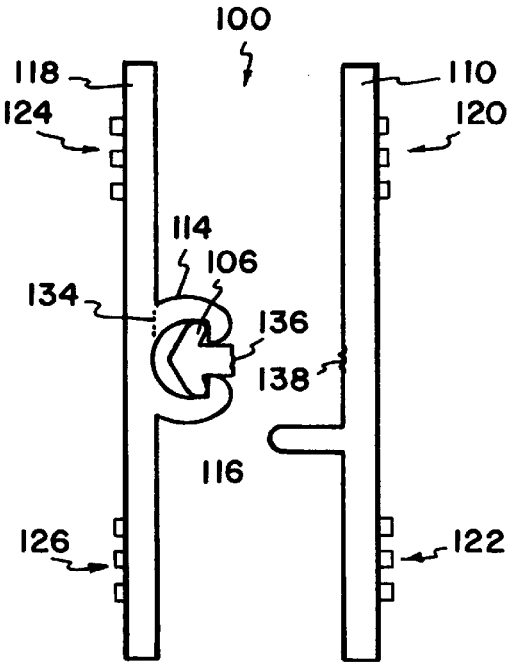
FIG. 9 is a fragmented, cross-sectional, schematic view of the closure mechanism depicted in FIGS. 7 and 8 and showing the male profile broken, according to an example embodiment of the present invention.

After initially closing or sealing closure mechanism 100, as shown in FIG. 8, if access is desired to the product side of the package interior, a pulling force on the closure mechanism 100 to pull female profile 104 and male profile 102 out of an interlocking relationship, will cause mechanical failure along one of the weakened regions 128, 132 and transformation to an unlockable orientation. For example, if weakened region 128 fails, die line 130 will tear to result in torn edges 136, 138, FIG. 9. As shown in FIG. 9, male head 106 remains nested between female legs 114, 116. Male stem 108 has been ripped from base strip 110. This permits access to the product side of the package, while rendering closure mechanism 100 inoperable. That is, closure mechanism 100 is not able to again reclose access to the interior of the package.

Figure 10:
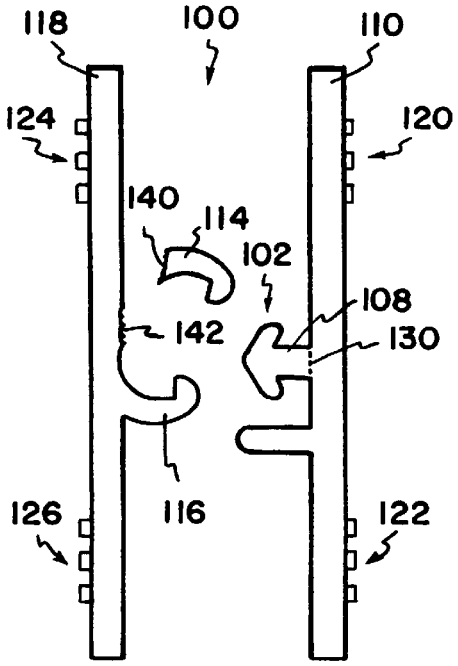
FIG. 10 is a fragmented, cross-sectional, schematic view of the closure mechanism depicted in FIGS. 7 and 8 and showing the female profile broken, according to an example embodiment of the present invention.

FIG. 10 illustrates closure mechanism 100 in the situation where weakened region 132 fails, instead of weakened region 128. If weakened region 132 fails, female profile 104 will be torn along die line 132 to create torn edges 140, 142, FIG. 10. As shown in FIG. 10, female leg 114 is separated from base strip 118. This renders closure mechanism 100 inoperable and unlockable. That is, male and female profiles 102, 104 cannot again mate and interlock in the manner depicted in FIG. 8.

Closure mechanism 100 may be used analogously to that described above for closure mechanism 50. Specifically, a package such as flexible package 30 having closure mechanism 100 bonded thereto is opened and items, such as groceries or clothing, are inserted through the open mouth 48. Prior to mating, the closure mechanism 100 will appear similarly to that shown in FIG. 7. Pressure is then applied to the male and female profiles 102, 104 to interlock the profiles in a closed, sealed, or locked orientation as shown in FIG. 8. In order to access the bag interior, the consumer must either tear the walls of the flexible package, or pull the male and female profiles 102, 104 apart. As the male and female profiles 102, 104 are pulled apart, the force exerted will induce mechanical failure along one of the weakened regions 128, 132, to render the closure mechanism 100 inoperable or unlockable. For example, weakened region 128 may fail by tearing along die line 130, FIG. 9. Alternatively, weakened region 132 may fail by tearing along die line 134. FIG. 10. The tears along either of the die lines 130, 134 will provide information that the closure mechanism 100 was previously closed and then reopened. As pointed out above, one useful application for this is in a department store, to ensure unpaid merchandise is not inserted inside of a package prior to leaving the department store.

Figure 11:
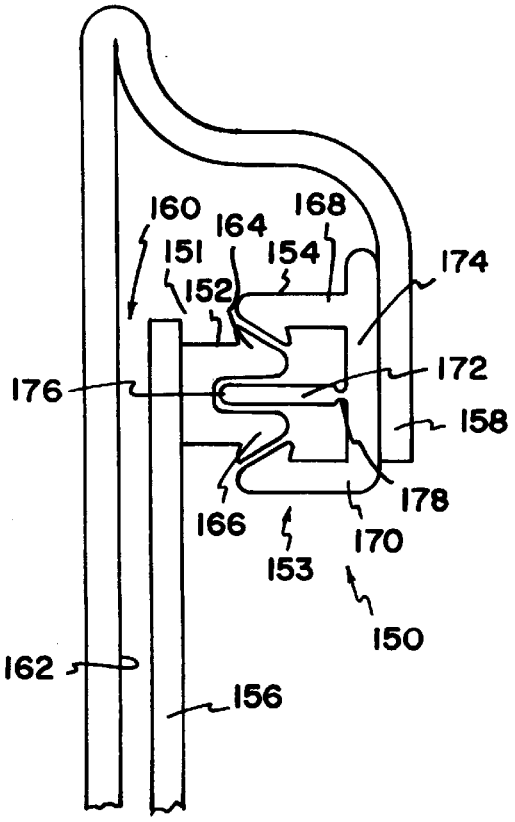
FIG. 11 is a fragmented, cross-sectional, schematic view of another embodiment of a closure mechanism, according to an example embodiment of the present invention.

Attention is directed to FIG. 11. In FIG. 11, another embodiment of a closure mechanism is illustrated generally at 150. Closure mechanism 150 includes first and second closure members 151, 153. First closure member 151 comprises a male profile 152, while second closure member 153 comprises an oppositely disposed female profile 154. Male profile 152 is secured to a package wall 156, while female profile 154 is secured to a package wall 158. In this embodiment, package wall 158 is folded over a mouth 160. Mouth 160 provides access to package interior 162.

Figure 13:
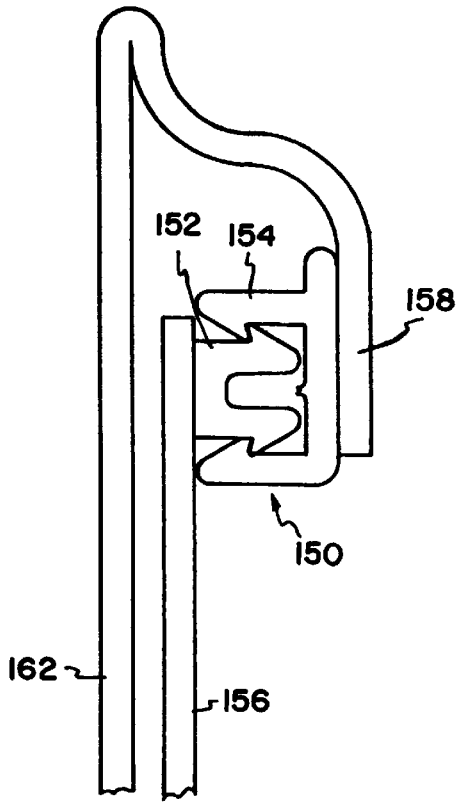
FIG. 13 is a fragmented, cross-sectional, schematic view of the closure mechanism depicted in FIGS. 11 and 12 and showing the male and female profiles in a mated or sealed orientation, according to an example embodiment of the present invention.

Still in reference to FIG. 11, male profile 152 includes a pair of male heads 164, 166 in extension from package wall 156. Female profile 154 includes a pair of legs 168, 170, for locking around male heads 164, 166, respectively. FIG. 13, to be described in more detail below, illustrates male and female profiles 152, 154 mated and interlocked in a sealed or closed orientation.

Closure mechanism 150 is constructed and arranged to prevent unintended interlocking of the male and female profiles 152, 154. In general, one of the male or female profiles 152, 154 may include structure which prevents the interlocking of the male and female profiles 152, 154, until the user intends to interlock them. In general, this may include structure on one of the male or female profiles 152, 154 which has a length more than any of the male heads 164, 166 and female legs 168, 170 which introduces interference and prevents the male heads 164, 166 from being encapsulated within legs 168, 170 and locking with legs 168, 170.

In the particular embodiment illustrated in FIG. 11, female profile 154 defines an elongate, removable post 172 extending and cantilevered from a base portion 174 of the female profile 154. Post 172 has a length which is greater than a length of legs 168, 170. As such, post 172, includes a tip 176, which projects past the outermost tips of legs 168, 170. As can be seen in FIG. 11, post 172 prevents the male and female profiles 152, 154 from mateably interlocking. Specifically, tip 176 abuts and engages male profile 152, which prevents any further relative motion between male and female profiles 152, 154.

Figure 12:
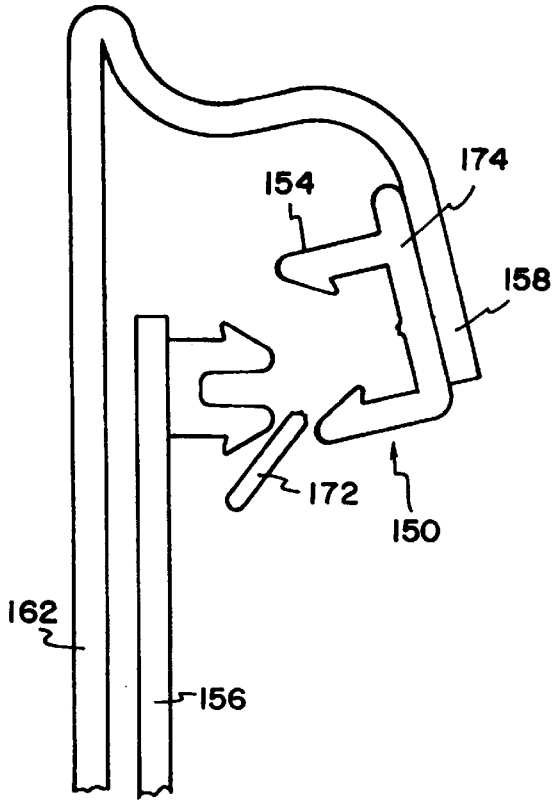
FIG. 12 is a fragmented, cross-sectional, schematic view of the closure mechanism depicted in FIG. 11 and showing a center post removed, according to an example embodiment of the present invention.

Attention is directed to FIG. 12. When it is desired to interlock male and female profiles 152, 154 and seal the package interior 162 closed, post 172 is removed from female profile 154. For example, post 172 may be secured to base portion 174 through a weakened, transverse region 178. FIG. 11, such as a die line or perforated region. The user grasps post 172 and pulls it relative to female profile 154 to tear it away from base portion 174. After removal of post 172, male profile 152 and female profile 154 may be mateably interlocked by sliding female profile 154 over male profile 152.

FIG. 13 illustrates closure mechanism 150 in a sealed or closed orientation. Note that post 172 is absent from the FIG. 13 illustration, in that it was removed in order to permit the interlocking engagement of male and female profiles 152, 154.

After closure mechanism 150 is sealed or closed to prevent access to package interior 162, it is not possible to access package interior 162 again, without tearing one or both of package walls 156, 158. In the specific embodiment illustrated, this is accomplished by orienting female closure profile 154 to be at or extending beyond the edge of package wall 158. In other words, male and female profiles 152, 154 lack flanges attaching them to the package walls 156, 158 and which are accessible to the user. Thus, the user has nothing to grasp to apply a pulling force in order to separate the male and female profiles 152, 154. If an attempt is made by the user to separate the male and female profiles 152, 154, the relative strength of the locking engagement between the male and female profiles 152, 154 will be greater than the tear strength of the package walls 156, 158. As such, the package walls 156, 158 will tear before the closure profiles 152, 154 can be separated.

Figure 14:
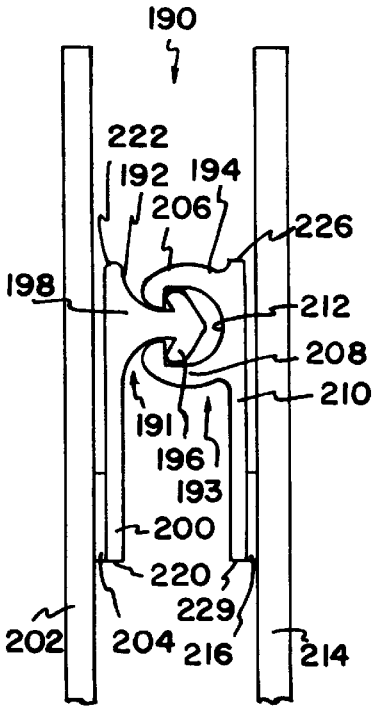
FIG. 14 is a fragmented, cross-sectional, schematic view of another embodiment of a closure mechanism, according to an example embodiment of the present invention.

Attention is now directed to FIG. 14. In FIG. 14, another embodiment of a closure mechanism is shown generally at 190. In general, closure mechanism 190 includes first and second closure members 191, 193. First closure member 191 includes a male profile 192, while second closure member 193 includes an oppositely disposed female profile 194. While a variety of profile shapes may be used, in the specific embodiment illustrated in FIG. 14, male profile 192 includes an expanded head 196 and an elongate stem 198 in extension from a base flange or strip 200. Base strip 200 is secured to a package wall 202 by a sealant layer 204. Sealant layer 204 may comprise a variety of materials, for example EVA.

Female profile 194 may also be of a variety of configurations. In the specific embodiment illustrated, female profile 194 has a pair of legs 206, 208 extending from a base flange or strip 210. Legs 206, 208 define an orifice 212 therebetween for receipt of head 196 of male profile 192.

Base strip 210 is secured to a package wall 214 through a sealant layer 216. Sealant layer 216 may comprise the same materials as sealant layer 204, described above.

In general, first closure member 191 has first and second opposite ends 220, 222. At first end 220, base strip 200 comprises an attachment flange for securing the first closure member 191 to the wall 202. At second end 222 is disposed male profile 192. In the embodiment illustrated, male profile 192 is free from and unattached to wall 202. Note also that first closure member 191 terminates at second end 222 with male profile 192. That is, there is no additional flange extending from the male profile 192 toward the consumer side of the package. Similarly, second closure member 193 has first and second opposite ends 224, 226, which function analogously to ends 220, 222. Female profile 194 is free from and unattached to wall 214, and no additional flanges extend from female profile 214 toward the consumer side.

FIG. 14 shows closure mechanism 190 in a sealed or closed orientation. That is, male and female profiles 192, 194 are interlocked and engaged.

Closure mechanism 190 is constructed and arranged to prevent access to the package interior after the closure mechanism has been closed, without tearing the package walls 202, 214. In the embodiment illustrated, this is accomplished by only attaching the male and female base strips 200, 210 to the bag walls 202, 214, respectively, on the package side of the base strips 200, 210, respectively. The base strips 200, 210 do not extend beyond the ends 222, 226 of the male profile 192 and female profile 194, such that there is nothing for the user to grasp to open the package, other than the package walls 202, 214. Male profile 192 is free from wall 202, and female profile 194 is free from wall 214.

Figure 15:
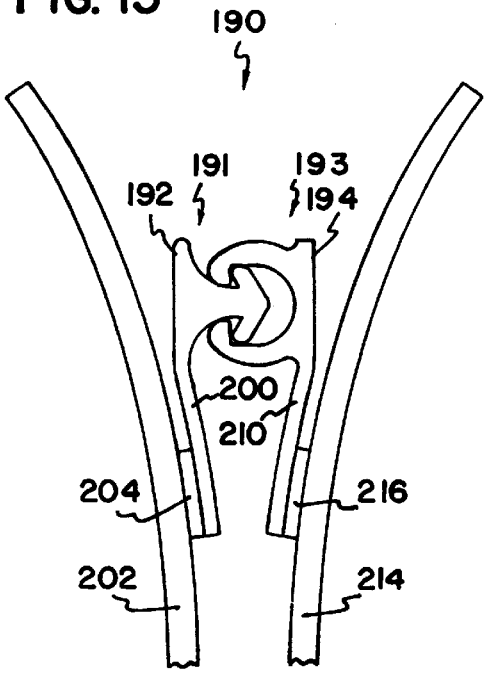
FIG. 15 is a fragmented, cross-sectional, schematic view of the closure mechanism depicted in FIG. 14 and showing pulling forces on walls of a package, according to an example embodiment of the present invention.

FIG. 15 illustrates the closure mechanism 190, when a pulling force is being applied to the arrangement. The user is grasping walls 202, 214 in order to try to separate the interlocked male and female closure profiles 192, 194. Closure mechanism 190 is designed so that enclosure strength between the male and female closure profiles 192, 194 is greater than the tear strength of the package walls 202, 214. Thus. eventually, either or both of package walls 202, 214 will tear or rip, to provide access to the package interior.

Figure 16:
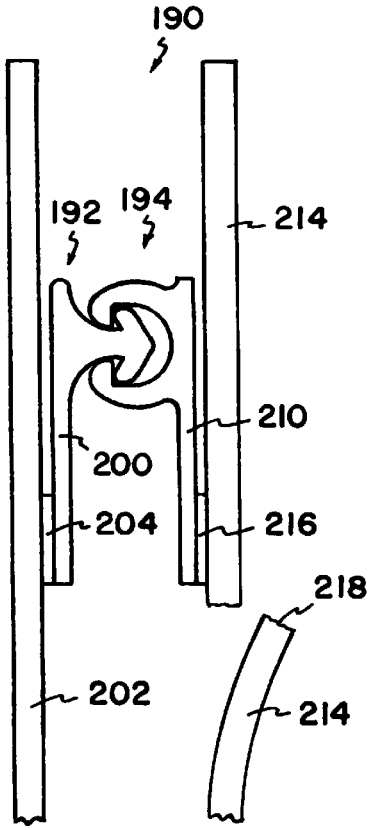
FIG. 16 is a fragmented, cross-sectional, schematic view of the closure mechanism depicted in FIGS. 14 and 15 and showing one of the walls of the package torn, according to an example embodiment of the present invention.

In FIG. 16, wall 214 is shown ripped or torn along edge 218. Thus, this torn edge 218 provides evidence that the package has been opened, after the closure mechanism 190 was sealed in its closed position.

Figure 17:
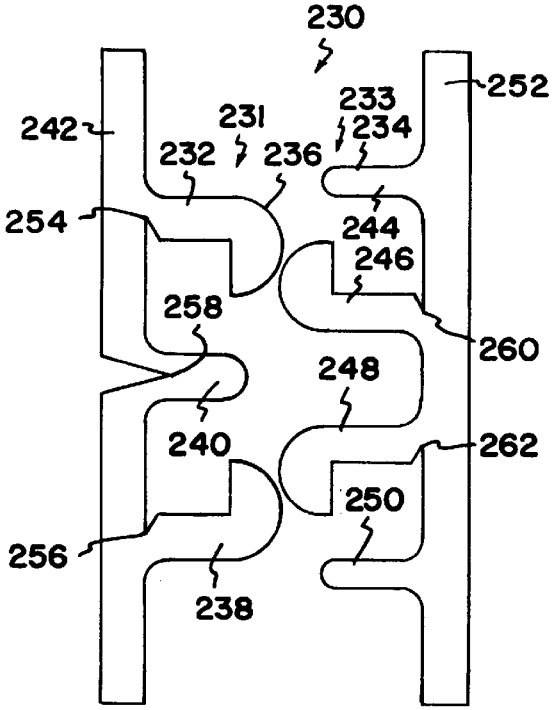
FIG. 17 is a fragmented, cross-sectional, schematic view of another embodiment of a closure mechanism, according to an example embodiment of the present invention.

Attention is now directed to FIG. 17. In FIG. 17, another embodiment of a closure mechanism is illustrated generally at 230. Closure mechanism 230 includes first and second closure members 231, 233. First closure member 231 preferably comprises a male profile 232 while second closure member 233 preferably comprises an oppositely disposed female profile 234 for mateably engaging and interlocking with male profile 232. Male and female profiles 232, 234 are generally analogous to male and female profiles 52, 54 with certain exceptions, to be described in more detail below.

Male profile 232 includes a first male member 236, a second male member 238, and a center post 240 therebetween. First male member 236, second male member 238, and center post project and extend from base strip 242.

Female profile 234 includes first leg 244, second leg 246, third leg 248, and fourth leg 250, each of which projects or extends from a base flange or strip 252.

Base strips 242, 252 are attached to package walls, analogous to first and second panel sections 34, 36 of FIG. 1, and walls 56, 58 of FIG. 2.

Male and female profiles 232, 234 male and engage to interlock in a closed or sealed orientation, analogous to the closed orientation shown in FIG. 3 of closure mechanism 50.

Closure mechanism 230 is constructed and arranged to prevent access to a package interior, such as interior 40, once the male and female closure profiles 232, 234 are interlocked in their closed position, without first rendering closure mechanism 230 to be inoperable. In other words, closure mechanism 230 is transformable from a lockable orientation (FIG. 17) to an unlockable orientation (FIG. 18) by disengaging or unmating the locked male and female profiles 232, 234. In the embodiment illustrated, closure mechanism 230 is configured to deform when pulling forces are applied to pull apart the mating male and female closure profiles 232, 234.

In the specific embodiment illustrated, male and female profiles 232, 234 include pivot points that bend when a pulling force is applied to them, causing the male and female profiles 232, 234 to deform. For example, first male member 236 defines a first pivot point at 254. First pivot point 254 is at the intersection between base strip 242 and first male member 236. It is defined by a region of reduced cross-sectional area across the width of the first male member 236. In the particular embodiment illustrated in FIG. 17, for example, the region of cross-sectional area removed from the first male member 236 is triangular-shaped. Analogously, second male member 238 defines a second pivot point at 256. Again, second pivot point 256 is defined by a region of reduced cross-sectional dimension at the transition point or intersection between base strip 242 and second male member 238. Further, center post 240 defines a third pivot point 258. Third pivot point 258 includes a region of reduced cross-sectional dimension over the width of the center post 240.

Female profile 234 also includes pivot points. For example, second leg 246 defines a fourth pivot point 260, and third leg 248 defines a fifth pivot point 262. Fourth and fifth pivots 260, 262 are analogous to pivot points 254, 256.

After the male and female profiles 232, 234 are secured in a closed or sealed orientation, analogous to the interlocked orientation of profiles 52, 54 of FIG. 3, they cannot be unlocked or unsealed without rendering the closure mechanism 230 inoperable or unlockable by deforming the male and female profiles 232, 234. Specifically, the pulling force exerted by the user to pull apart the male and female profiles 232, 234 induce pivoting about pivot points 254, 256, 258, 260, and 262. The pivoting about the pivot points causes permanent bending and deformation in the male and female profiles 232, 234, causing loss of the integrity of the locking mechanism 230. By "permanent bending," it is meant that the profiles have exceeded their elastic limits, and do not snap back into place as in their unbent orientations (FIG. 17).

Figure 18:
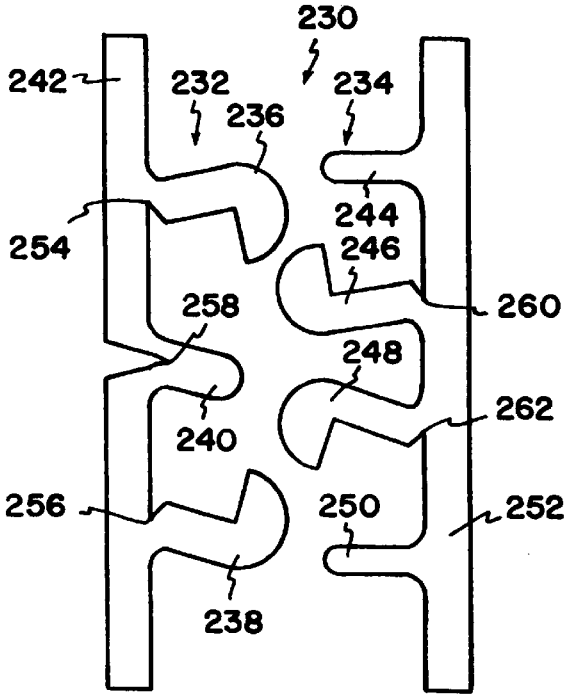
FIG. 18 is a fragmented, cross-sectional, schematic view of the closure mechanism depicted in FIG. 17 and showing the closure mechanism deformed after unmating of the profiles, according to an example embodiment of the present invention.

For example, attention is directed to FIG. 18. In FIG. 18, an example of the male and female profiles 232, 234 are depicted after being pulled apart and in a deformed and unlockable condition. As can be seen in FIG. 18, first male member 236 is permanently deflected and bent about pivot point 254 and angled toward base strip 242 and away from second male member 238. Center post 240 has been bent and angled toward the second male member 238 and toward base strip 242. Second male member 238 has been deformed and bent outwardly away from first male member 236 and toward base strip 242, pivoted about second pivot point 256. In female profile 234, second leg 246 has been pivoted about pivot point 260 toward the third leg 248. Similarly, third leg 248 has been pivoted about pivot point 262 toward second leg 246. These permanent deformations in the shapes of male and female profiles 232, 234 preclude re-use of the closure mechanism 230.

As with previous embodiments described herein, one application for closure mechanism 230 is with a flexible package, where it is desirable to have information about whether the closure mechanism 230 has been opened after initial closing. In the embodiment of FIGS. 17 and 18, inspection of the closure mechanism 230 would indicate whether the male and female profiles 232, 234 are deformed. If they are deformed, it means that the male and female profiles 232, 234 have already once been sealed or closed and then reopened. This can be useful if used in a department store for security provisions, such as those applications described above.

Several of the embodiments as described herein may be modified to include a recloseable closure mechanism, to permit the user to reclose the package even after destruction or rendering of the original closure mechanism as inoperable.

Figure 19:
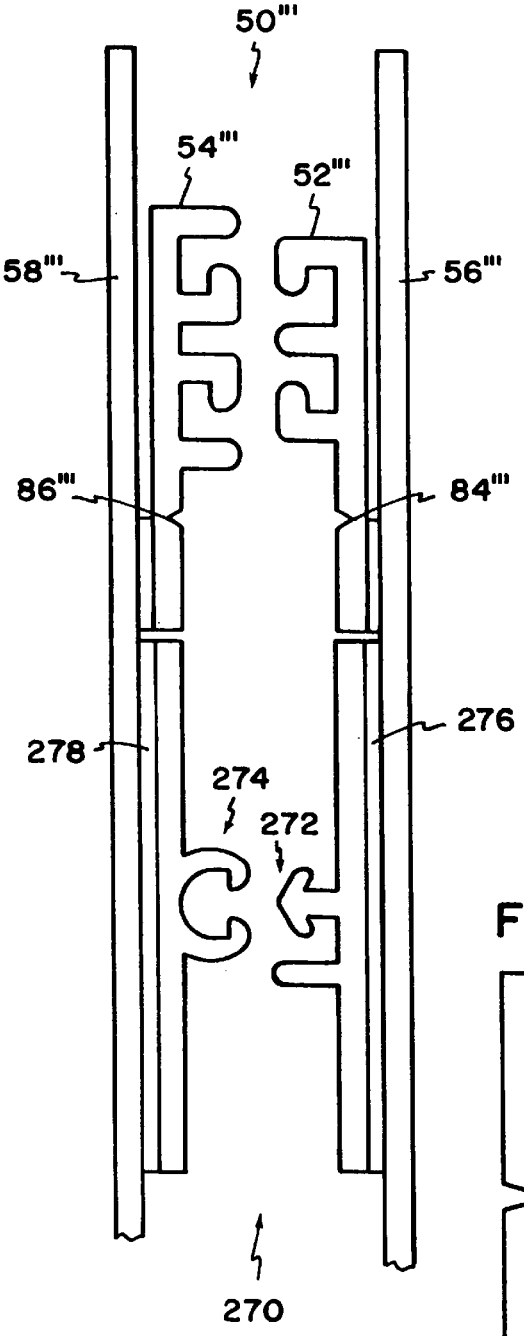
FIG. 19 is a fragmented, cross-sectional, schematic view of the closure mechanism of FIG. 2 and modified to include an additional closure mechanism, according to an example embodiment of the present invention.

For example, attention is directed to FIG. 19. In FIG. 19 the closure mechanism depicted in FIG. 2 is shown generally at 50'''. Closure mechanism 50''' having male profile 52''' and female profile 54''' and secured to walls 56''', 58''', respectively, includes a recloseable closure mechanism 270 oriented adjacent thereto. Recloseable closure mechanism 270 is preferably oriented on the product side of the closure mechanism 50'''. In this way, after closure mechanism 50''' has been initially closed and then opened by tearing at one of die lines 84''', 86''', the package may still be reclosed through operation of recloseable closure mechanism 270. Recloseable closure mechanism 270 may comprise any of a variety of recloseable closure mechanisms known to one skilled in the art. In the specific embodiment illustrated in FIG. 19, recloseable closure mechanism 270 includes a male closure profile 272 and an opposed female closure profile 274. Male and female profiles 272, 274 may be secured to walls 56''', 58''', respectively, through any of a variety of processes known in the art. In the specific embodiment illustrated, male and female profiles 272, 274 are secured to walls 56''', 58''', respectively, through sealant layers 276, 278, respectively. In the FIG. 19 embodiment, recloseable closure mechanism 270 is shown as separate and distinct from closure mechanism 50'''. It should be understood, however, that recloseable closure mechanism 270 may be extruded as a single piece with closure mechanism 50'''.

Figure 20:
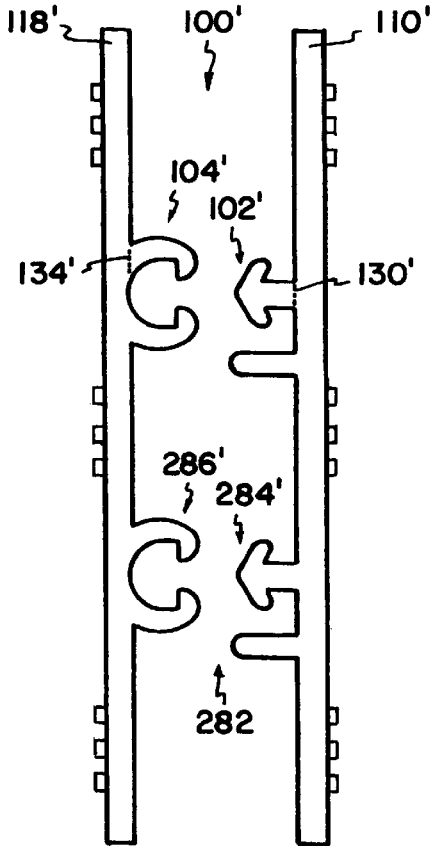
FIG. 20 is a fragmented, cross-sectional, schematic view of the closure mechanism of FIG. 7 and modified to include an additional closure mechanism,according to an example embodiment of the present invention.

In FIG. 20, the closure mechanism of FIG. 8 is shown modified at 100'. Specifically, adjacent to and below male and female profiles 102', 104' is a recloseable closure mechanism 282. In this embodiment, recloseable closure mechanism 282 is extruded as the same piece as male and female profiles 102', 104'. Recloseable closure mechanism 282 permits reclosing of the flexible package after an initial closing and opening of closure mechanism 100'. That is, after one of the die lines 130', 134' has been torn to render closure mechanism 100' inoperable, recloseable closure mechanism 282 permits closing and reopening of the package. While recloseable closure mechanism 282 can include any of a number of recloseable mechanisms known to one skilled in the art, recloseable closure mechanism 282 includes male profile 284 and oppositely disposed female profile 286, analogous to that illustrated in FIG. 19 at 272, 274.

Figure 21:
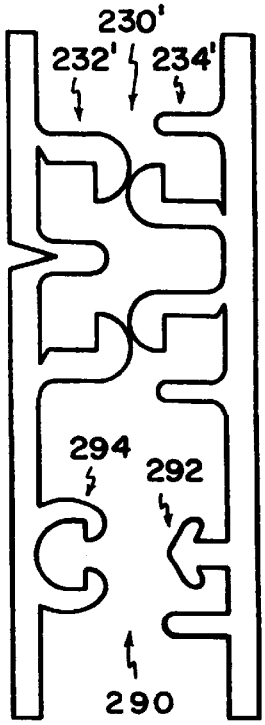
FIG. 21 is a fragmented, cross-sectional, schematic view of the closure mechanism of FIG. 17 and modified to include an additional closure mechanism, according to an example embodiment of the present invention.

In FIG. 21, a depiction of a modification of the arrangement in FIG. 17 is shown to include a recloseable closure mechanism. Specifically, closure mechanism 230' has adjacent thereto and below male and female closure profiles 232', 234' a recloseable closure mechanism 290. As with the embodiments of FIGS. 19 and 20, recloseable closure mechanism 290 permits repeated opening and reclosing of a flexible package, after destruction or deformation of closure mechanism 230'. In FIG. 21, recloseable closure mechanism 290 comprises a male profile 292 and an oppositely disposed female profile 294. In addition to the male and female profiles 292, 294 shown in FIG. 21, other profile shapes may be used, consistent with what is understood in the art. It should be noted that the closure mechanisms illustrated in FIGS. 20 & 21, in general, may also be secured to walls of a flexible package.

With reference to FIGS. 2–6, 17–19 and 21, the 4-member portion, such as closure member 53, has been identified as having a female closure profile 54. Conventionally, the 4-member portion is called the male member. It is believed that this difference in nomenclature is insignificant.

The closure arrangements described herein may be manufactured using conventional extrusion and heat sealing techniques. For example, the closure profiles may be extruded through a die plate fed by an extruder. The extruder carries a molten material for forming the closure profiles. As is well-known in the art, the die plate includes input ports, output ports, and channels connecting these input ports to output ports. The extruder feeds the molten material to input ports, and the channels are designed to configure the molten material into the shapes of the closure profiles. Generally, the closure profiles may be extruded from a polymeric resin such as polyethylene.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A closure arrangement for use with a flexible package; the closure arrangement comprising:

(a) a first closure member; said first closure member having a first base strip and a first profile in extension from said first base strip;

(i) said first base strip having a first die line;

(ii) said first profile being separable from a remaining portion of said first closure member along said first die line in response to a pulling force;

(b) a second closure member; said second closure member having a second base strip and a second profile in extension from said second base strip;

(i) said first and second profiles being constructed and arranged to interlock;

(ii) said second base strip having a second die line;

(iii) said second profile being separable from a remaining portion of said second closure member along said second die line in response to a pulling force;

(c) a first sealant layer attached to said first base strip; said first sealant layer having an end adjacent to said first die line; and (d) a second sealant layer attached to said second base strip; said second sealant layer having an end adjacent to said second die line.

2. A closure arrangement according to claim 1 wherein:

(a) said first profile includes dual tracks.

3. A closure arrangement according to claim 2 wherein:

(a) said second profile includes dual tracks.

4. A closure arrangement according to claim 1 wherein:

(a) said end of said first sealant layer is even with said first die line.

5. A closure arrangement according to claim 4 wherein:

(d) said end of said second sealant layer is even with said second die line.

6. A flexible package comprising:

(a) a first film wall;

(b) a second film wall opposed to and secured to said first film wall;

(i) said first and second walls defining an enclosed interior and a product-supporting bottom;

(ii) said first and second walls defining a mouth at end opposite to said product-supporting bottom; said mouth having an open position and a closed position; said open position providing access to said interior; said closed position blocking access to said interior; and (c) a closure arrangement for moving said mouth from said open position to said closed position; said closure arrangement including:

(i) a first closure member; said first closure member having a first base strip and a first profile in extension from said first base strip;

(A) said first base strip having a first die line;

(B) said first profile being separable from a remaining portion of said first closure member along said first die line in response to a pulling force;

(ii) a second closure member; said second closure member having a second base strip and a second profile in extension from said second base strip;

(A) said first and second profiles being constructed and arranged to interlock;

(B) said second base strip having a second die line;

(C) said second profile being separable from a remaining portion of said second closure member along said second die line in response to a pulling force;

(iii) a first sealant layer attached to said first base strip and attached to said first film wall; said first sealant layer having an end adjacent to said first die line; and (iv) a second sealant layer attached to said second base strip and attached to said second film wall; said second sealant layer having an end adjacent to said second die line.

7. A flexible package according to claim 6 wherein:

(a) said first profile extends outside of said interior and beyond an end of said first film wall.

8. A flexible package according to claim 7 wherein:

(a) said second profile extends outside of said interior and beyond an end of said second film wall.

9. A flexible package according to claim 6 wherein:

(a) said first profile includes dual tracks.

10. A flexible package according to claim 9 wherein:

(a) said second profile includes dual tracks.

11. A flexible package according to claim 6 wherein:

(a) said end of said first sealant layer is even with said first die line.

12. A flexible package according to claim 11 wherein:

(d) said end of said second sealant layer is even with said second die line.

* * * * *